US009493962B2

(12) United States Patent
Eddy

(10) Patent No.: US 9,493,962 B2
(45) Date of Patent: Nov. 15, 2016

(54) UMBRELLA STAND

(71) Applicant: Darrel W. Eddy, Cedar Rapids, IA (US)

(72) Inventor: Darrel W. Eddy, Cedar Rapids, IA (US)

( * ) Notice: Subject to any disclaimer, the term of this patent is extended or adjusted under 35 U.S.C. 154(b) by 0 days.

(21) Appl. No.: 14/870,191

(22) Filed: Sep. 30, 2015

(65) Prior Publication Data

US 2016/0088909 A1 Mar. 31, 2016

Related U.S. Application Data

(60) Provisional application No. 62/057,454, filed on Sep. 30, 2014.

(51) Int. Cl.
*F16M 13/00* (2006.01)
*E04H 12/22* (2006.01)

(52) U.S. Cl.
CPC ..... *E04H 12/2261* (2013.01)

(58) Field of Classification Search
CPC ... A45B 11/00; A45B 2025/003; A45B 3/52
See application file for complete search history.

(56) References Cited

U.S. PATENT DOCUMENTS

2011/0260029 A1* 10/2011 Kost ..... A45B 11/00 248/514

* cited by examiner

*Primary Examiner* — Amy Sterling

(57) ABSTRACT

An umbrella stand is used to mount umbrellas or flags to tables, vehicles, structures, and various structures. The umbrella stand includes a mounting assembly and a rod holder. The rod holder is used to attach an umbrella or flag to the umbrella stand. The mounting assembly is used to secure the umbrella or flag to a surface. The mounting assembly includes a support plate, a first mounting plate and a first mounting fastener. The support plate is used as a base. The first mounting plate and the first mounting fastener connect to the support plate and help secure the support plate to a surface. The rod holder includes a holder tube and a plurality of holder fasteners. The holder tube is connected to the support plate and houses the shaft of an umbrella or a flagpole. The plurality of holder fasteners secure the umbrella shaft or the flagpole in place.

17 Claims, 8 Drawing Sheets

UMBRELLA STAND

The current application claims a priority to the U.S. Provisional Patent application Ser. No. 62/057,454 filed on Sep. 30, 2014.

FIELD OF THE INVENTION

The present invention relates generally to an apparatus for holding umbrellas, flags, and other similar items. More specifically, the present invention is an umbrella stand which may be mounted on a table, vehicle, or various horizontal or vertical surfaces.

BACKGROUND OF THE INVENTION

Umbrellas are often used to protect people from excessive rain or sun and may be handheld or free standing. Free standing umbrellas must either be supported by a stand or mount, or must be driven into the ground. When using umbrellas at an outdoor table setting, it is generally required that there be a hole in the table through which the shaft of the umbrella can fit. As a result, many tables are not compatible with umbrellas.

Flags, like umbrellas, often require some sort of stand or mount to keep from falling over. Common flag mounts are either bolted, screwed, or nailed to a flat surface. While such types of flag mounts are relatively effective, they are permanent, and therefore cannot be repeatedly used at multiple locations.

Accordingly, there is a present need for an apparatus that may be used to mount umbrellas or flags to multiple types of tables, objects, or surfaces. The present invention is an umbrella stand that may be used to mount an umbrella or flag to a picnic table, or any similar structure. The present invention may also be used to mount an umbrella or flag to a vehicle, dwelling, or various flat surfaces.

DETAILED DESCRIPTION OF THE INVENTION

All illustrations of the drawings are for the purpose of describing selected versions of the present invention and are not intended to limit the scope of the present invention.

Figure 1:
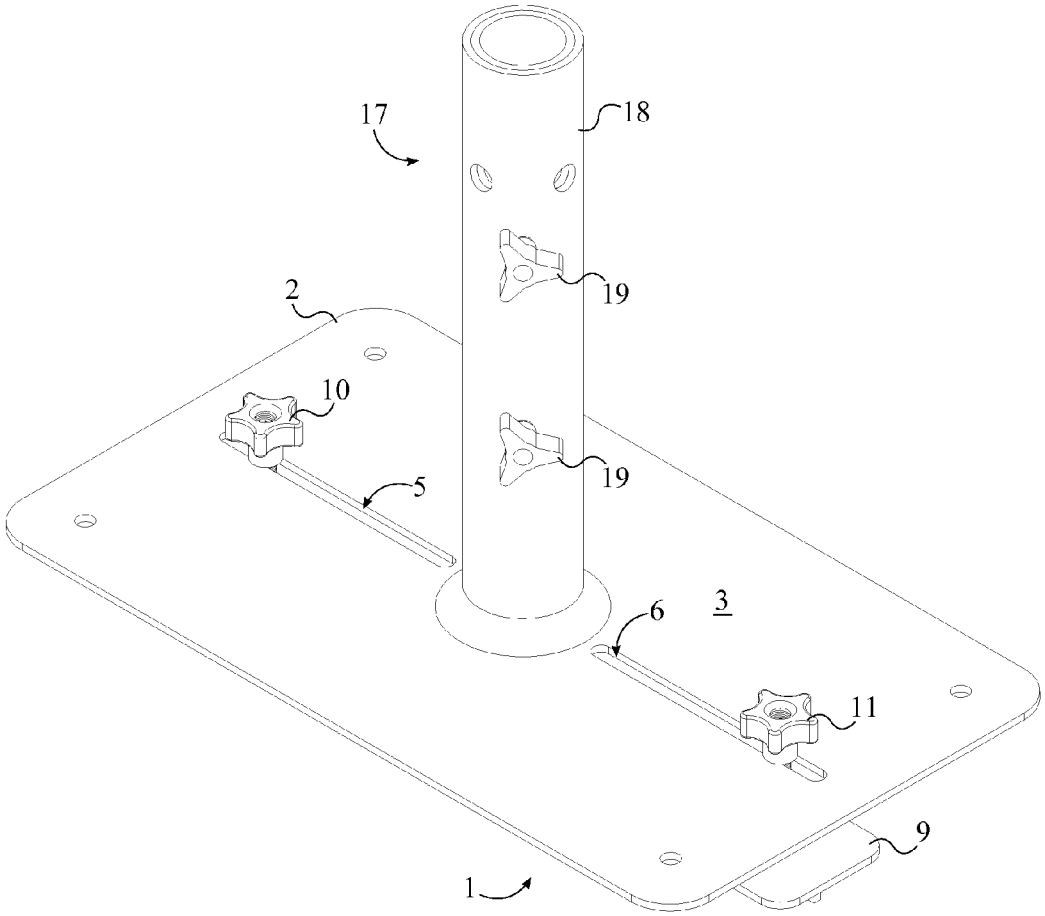
FIG. 1 is a perspective view of the present invention.
Figure 2:
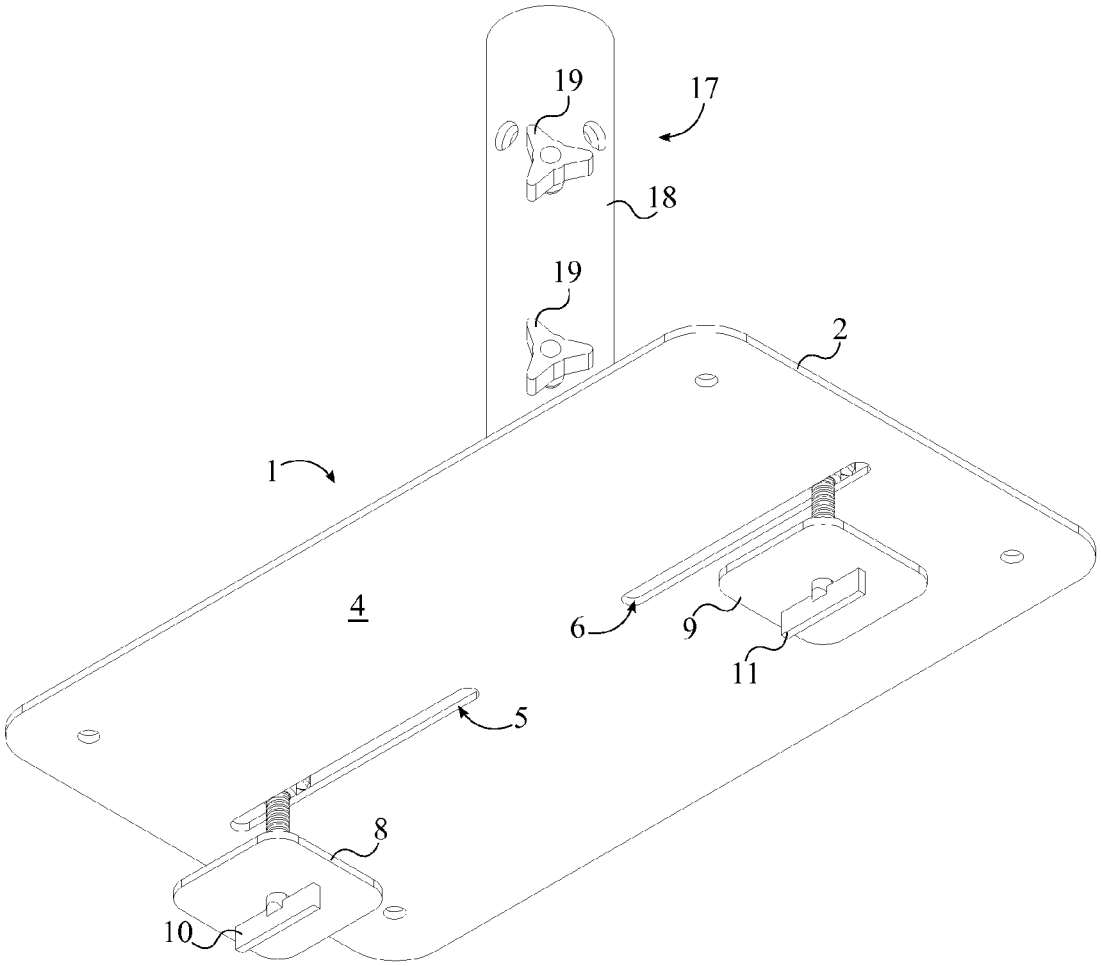
FIG. 2 is a bottom perspective view of the present invention.

With reference to FIGS. 1-2, the present invention is an umbrella stand which is used to mount an umbrella to tables, decks, docks, walls, vehicles, and various surfaces. The present invention comprises a mounting assembly 1 and a rod holder 17. The mounting assembly 1 comprises a support plate 2, a first mounting plate 8, a second mounting plate 9, a first mounting fastener 10, and a second mounting fastener 11. The support plate 2 acts as a base for the present invention and comprises a top surface 3 and a bottom surface 4. In the preferred embodiment of the support plate 2 is 14 inches (in) by 8 in and 3/16 in thick. The rod holder 17 is used to support the shaft of an umbrella or a flagpole and comprises a holder tube 18 and a plurality of holder fasteners 19. The holder tube 18 is connected adjacent and normal to the top surface 3. In the preferred embodiment of the present invention, the holder tube 18 is 10 in long and has a ⅛ in wall thickness. An umbrella shaft or a flagpole may be inserted into the holder tube 18. Each of the plurality of holder fasteners 19 is laterally engaged into the holder tube 18 such that the umbrella or flag may be secured. The first mounting plate 8 is positioned parallel to the bottom surface 4 and is mounted offset from the bottom surface 4 by the first mounting fastener 10. The first mounting fastener 10 is positioned adjacent to the holder tube 18 and is used to secure the present invention to a tabletop or similar surface. The arrangement of the first mounting plate 8 and the first mounting fastener 10 allows the present invention to be clamped to a picnic table, a wire table, and other types of tables. Specifically, the first mounting fastener 10 may be guided through the spaces between boards of a picnic table or the spaces between wires in a wire table. Alternatively, the present invention may be secured to the edge of a table with no gaps or holes. When using the present invention, the first mounting plate 8 is pressed against the underside of a table to secure the support plate 2.

In reference to FIG. 2, the second mounting plate 9 and the second mounting fastener 11 operate together in the same way as the first mounting plate 8 and the first mounting fastener 10. In the preferred embodiment, the first mounting plate 8 and the second mounting plate 9 are both 2¼ in by 2¼ in with a thickness of ⅛ in. The second mounting plate 9 and the second mounting fastener 11 can be used in addition to the first mounting plate 8 and the first mounting fastener 10 if, the first mounting plate 8 and the first mounting fastener 10 cannot adequately secure the support plate 2. Like the first mounting plate 8, the second mounting plate 9 is positioned parallel to the bottom surface 4 and is mounted offset from the bottom surface 4 by the second mounting fastener 11. The second mounting fastener 11 is positioned adjacent to the holder tube 18 and opposite to the first mounting fastener 10. This positioning provides equal stability to the support plate 2.

Figure 3:
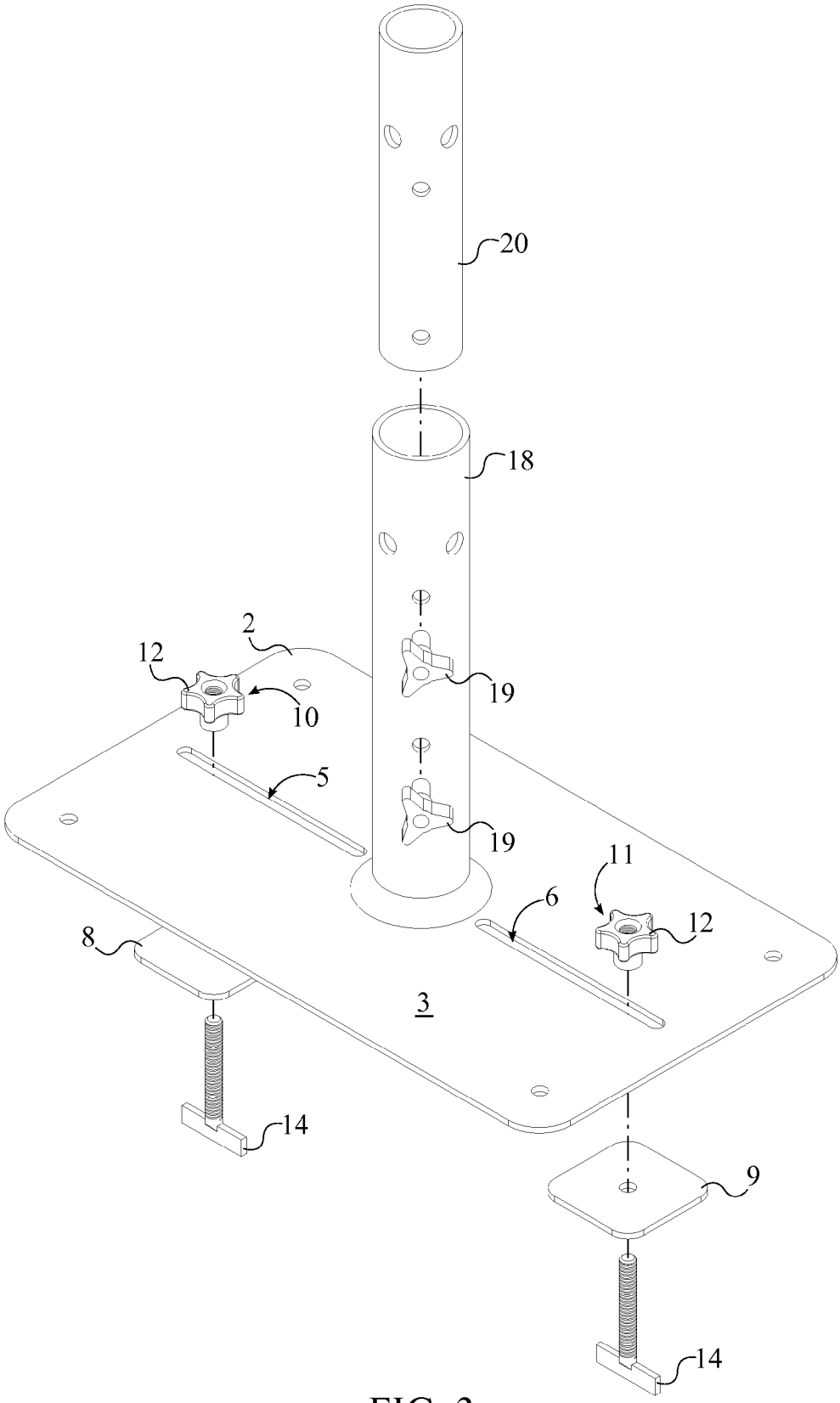
FIG. 3 is an exploded perspective view of the present invention.

In reference to FIG. 3, the support plate 2 further comprises a first mounting slot 5 and a second mounting slot 6. The first mounting slot 5 and the second mounting slot 6 provide a means of securing the first mounting fastener 10 and the second mounting fastener 11 to the support plate 2. The first mounting slot 5 and the second mounting slot 6 both traverse through the support plate 2 from the top surface 3 to the bottom surface 4. The first mounting slot 5 is positioned adjacent to the holder tube 18. The second mounting slot 6 is positioned adjacent to the holder tube 18, opposite to the first mounting slot 5. The first mounting fastener 10 is slidably engaged through the first mounting slot 5, and the second mounting fastener 11 is slidably engaged through the second mounting slot 6. This arrangement allows the first mounting fastener 10 and the second mounting fastener 11 to be properly positioned such that the support plate 2 can be firmly secured to a table or surface. Because tables vary in size and construction, it is necessary to account for such variability. The use of the first mounting slot 5 and the second mounting slot 6 allow the support plate 2 to be mounted in various positions and to various objects or surfaces.

Figure 5:
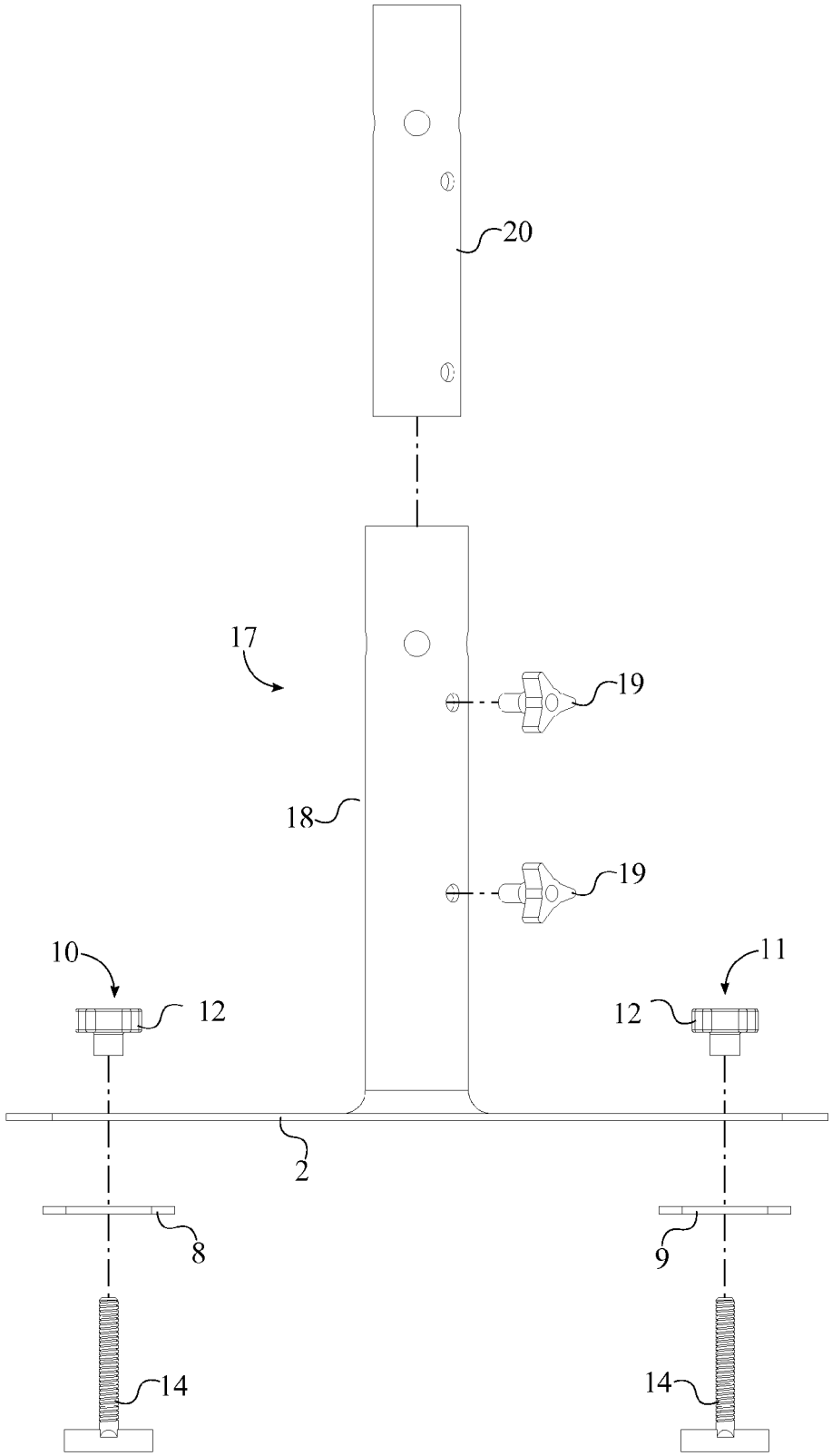
FIG. 5 is an exploded front view of the present invention
Figure 6:
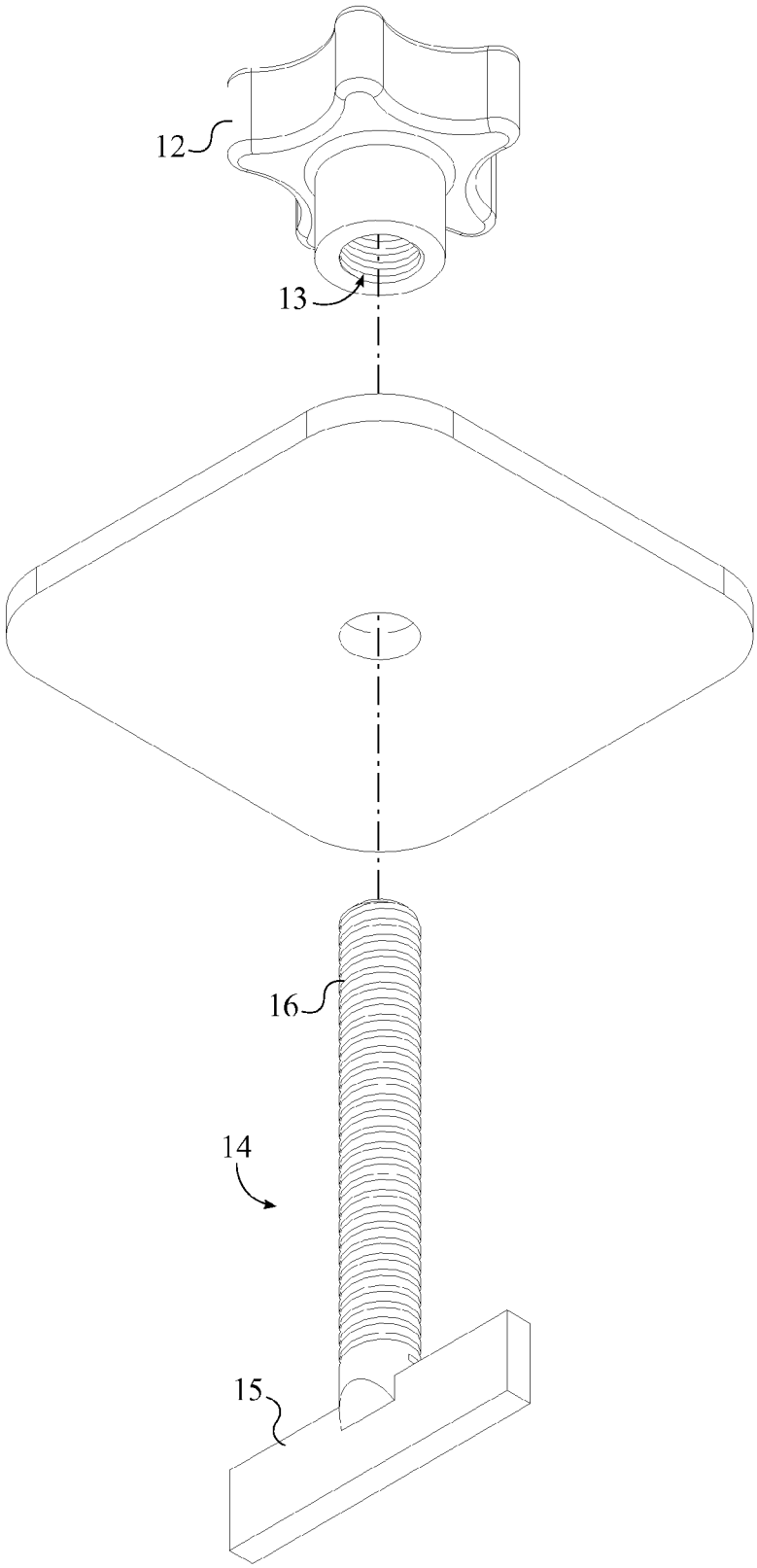
FIG. 6 is an exploded perspective view detailing how the screw handle and the hand know interact with a mounting plate.

In reference to FIGS. 5-6, the first mounting fastener 10 and the second mounting fastener 11 each comprise a hand knob 12 and a screw handle 14. The screw handle 14 comprises a handlebar 15 and a male-threaded rod 16. The handlebar 15 is connected perpendicular and adjacent to the male-threaded rod 16. The male-threaded rod 16 traverses through the support plate 2, normal to the bottom surface 4. The male-threaded rod 16 protrudes through the support plate 2 such that a female-threaded portion 13 of the hand knob 12 can be engaged about the male-threaded rod 16. In order to adjust the positioning of the screw handle 14 relative to the hand knob 12, the user may turn the hand knob 12 while either holding the handlebar 15 or turning the handlebar 15 in an opposite direction of the hand knob 12.

The male-threaded rod 16 of the first mounting fastener 10 traverses through the first mounting plate 8. The first mounting plate 8 is positioned in between the handlebar 15 of the first mounting fastener 10 and the bottom surface 4. The first mounting plate 8 is prevented from sliding past the male-threaded rod 16 by the handlebar 15. Therefore, as the handlebar 15 is moved towards the bottom surface 4 of the support plate 2 by tightening the hand knob 12, the first mounting plate 8 is forced towards the bottom surface 4. This process is used to firmly clamp the present invention to a table or surface. In some applications, such mounting an umbrella to a wooden patio deck, or other objects which use tightly spaced panels or beams, the first mounting plate 8 and the second mounting plate 9 are not necessary to mount the present invention. In the example of a wooden patio deck, where both sides of the wooden panels are not easily accessible, the user may insert the screw handle 14 in between two wooden panels of the patio from above the wooden panels. The user may then turn the screw handle 14 until the handlebar 15 is positioned perpendicular to the gap between the two wooden panels. This prevents the screw handle 14 from being lifted back through the gap in between the two wooden panels. The hand knob 12 may then be tightened to the male-threaded rod 16.

Similar to the first mounting fastener 10, the male-threaded rod 16 of the second mounting fastener 11 traverses through the second mounting plate 9. The second mounting plate 9 is positioned in between the handlebar 15 of the second mounting fastener 11 and the bottom surface 4. The second mounting plate 9 is prevented from sliding past the male-threaded rod 16 by the handlebar 15. Therefore, as the handlebar 15 is moved towards the bottom surface 4 of the support plate 2 by tightening the hand knob 12, the second mounting plate 9 is forced towards the bottom surface 4. This process is used to further secure the present invention to a table or surface. When mounting the present invention to the back of a vehicle, the first mounting fastener 10 and the second mounting fastener 11 may be attached through a hitch attachment at the rear of the vehicle. This configuration is useful for mounting a flag to a vehicle.

Figure 7:
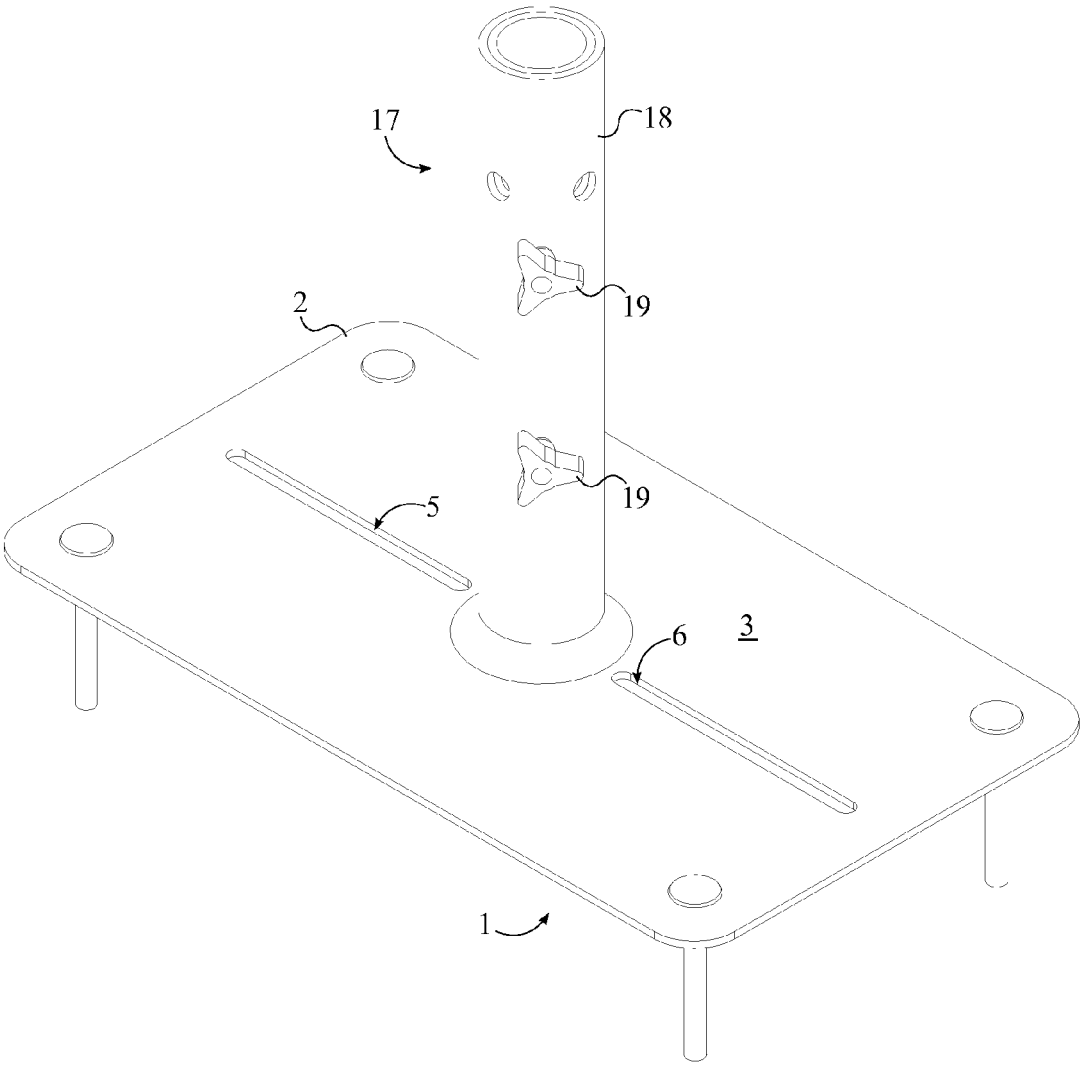
FIG. 7 is a perspective view of the present invention, wherein bolts are positioned within the plurality of mounting holes.
Figure 8:
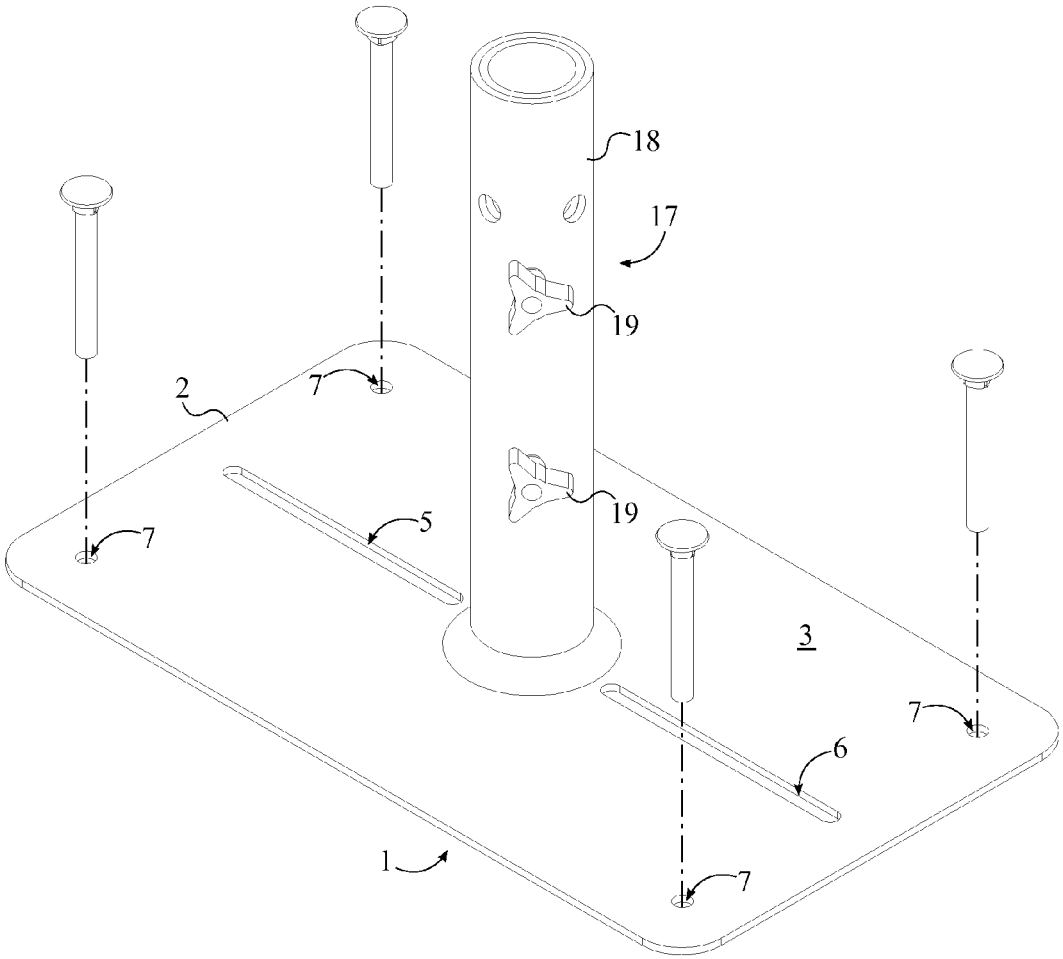
FIG. 8 is an exploded perspective view of the present invention, wherein bolts are positioned within the plurality of mounting holes.

In reference to FIGS. 7-8, the mounting assembly 1 further comprises a plurality of mounting holes 7. The plurality of mounting holes 7 traverses through the support plate 2 and is used to mount the support plate 2 to surfaces that cannot clamped by the first mounting fastener 10 and the first mounting plate 8. The plurality of mounting holes 7 is perimetrically distributed across the support plate 2, providing the ability to securely mount the support plate 2 to a surface. Bolts, screws, or nails may be used to mount the support plate 2. The support plate 2 may be mounted to a heavy object, such as a slab of concrete, thus, creating a stable base for a flag or umbrella to stand. Moreover, the support plate 2 may be mounted to a truck, camper, or house by bolting the support plate 2 through the plurality of mounting holes 7 and into the desired surface.

Figure 4:
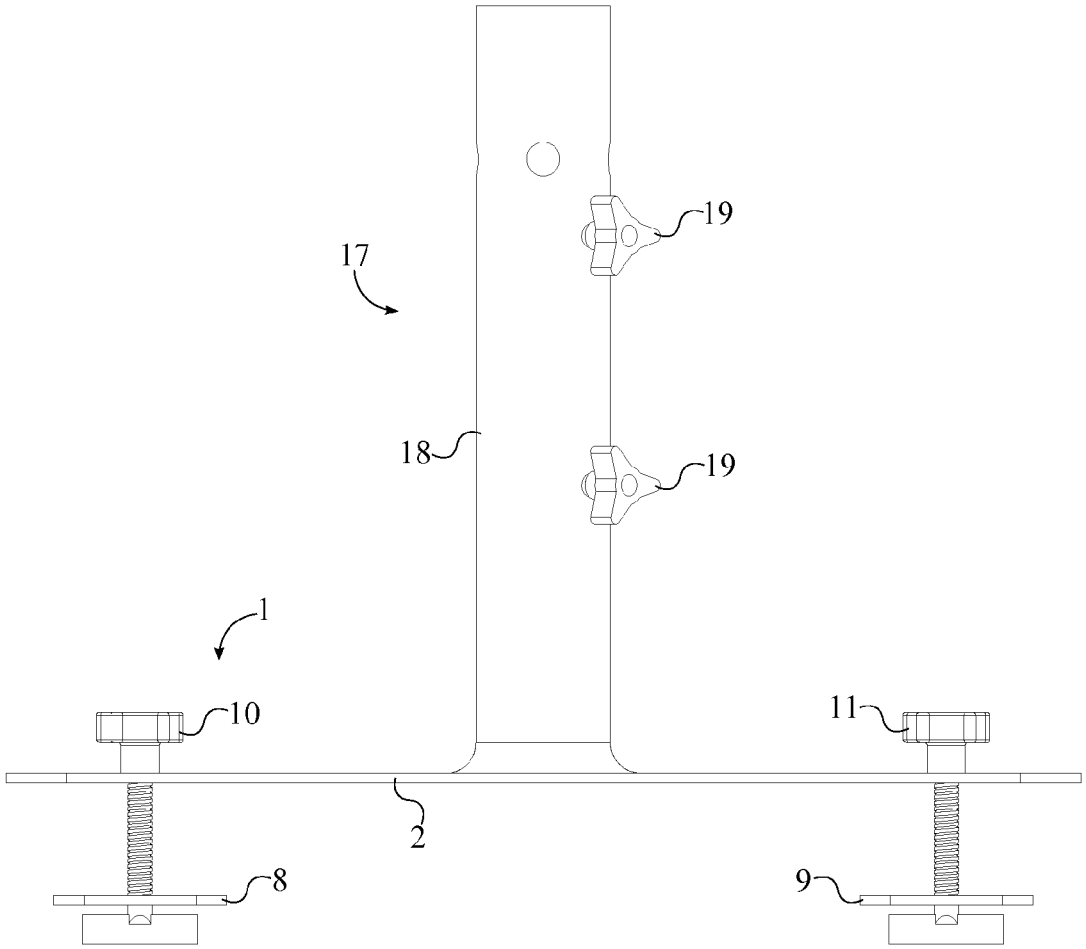
FIG. 4 is a front view of the present invention.

In reference to FIGS. 3-5, the rod holder 17 further comprises a sizing tube 20. The sizing tube 20 is concentrically nested within the holder tube 18 and is used to make the rod holder 17 compatible with umbrellas shafts and flagpoles of different diameters. For flagpoles and umbrella shafts that do not fit snuggly within the holder tube 18, the sizing tube 20 may be inserted to effectively provide a better fit. When securing the flagpole or umbrella shaft inside the sizing tube 20, the plurality of holder fasteners 19 traverses into the holder tube 18 and the sizing tube 20. The plurality of holder fasteners 19 is then able to contact the umbrella shaft or the flagpole, thereby fixing the position of the umbrella shaft or the flagpole.

Although the invention has been explained in relation to its preferred embodiment, it is to be understood that many other possible modifications and variations can be made without departing from the spirit and scope of the invention as hereinafter claimed.

What is claimed is:

1. An umbrella stand comprises:

a mounting assembly;

a rod holder;

the mounting assembly comprises a support plate, a first mounting plate, a second mounting plate, a first mounting fastener, and a second mounting fastener;

the rod holder comprises a holder tube and a plurality of holder fasteners;

the support plate comprises a top surface and a bottom surface;

the holder tube being connected adjacent and normal to the top surface;

each of the plurality of holder fasteners being laterally engaged into the holder tube;

the first mounting plate being positioned parallel to the bottom surface;

the first mounting plate being mounted offset from the bottom surface by the first mounting fastener;

the first mounting fastener being positioned adjacent to the holder tube;

the rod holder further comprises a sizing tube;

the sizing tube being concentrically nested within the holder tube; and the plurality of holder fasteners traversing into the holder tube and the sizing tube.

2. The umbrella stand as claimed in claim 1 comprises:

the second mounting plate being positioned parallel to the bottom surface;

the second mounting plate being mounted offset from the bottom surface by the second mounting fastener; and the second mounting fastener being positioned adjacent to the holder tube.

3. The umbrella stand as claimed in claim 1 comprises:

the support plate further comprises a first mounting slot and a second mounting slot;

the first mounting slot traversing through the support plate from the top surface to the bottom surface;

the second mounting slot traversing through the support plate from the top surface to the bottom surface;

the first mounting slot being positioned adjacent to the holder tube; and the second mounting slot being positioned adjacent to the holder tube, opposite to the first mounting slot.

4. The umbrella stand as claimed in claim 3, wherein the first mounting fastener is slidably engaged through the first mounting slot.

5. The umbrella stand as claimed in claim 3, wherein the second mounting fastener is slidably engaged through the second mounting slot.

6. The umbrella stand as claimed in claim 1 comprises:
the first mounting fastener and the second mounting fastener each comprise a hand knob and a screw handle;
the screw handle comprises a handlebar and a male-threaded rod;
the handlebar being connected perpendicular and adjacent to the male-threaded rod;
the male-threaded rod traversing through the support plate, normal to the bottom surface; and
a female-threaded portion of the hand knob being engaged about the male-threaded rod.

7. The umbrella stand as claimed in claim 6 comprises:
the male-threaded rod of the first mounting fastener traversing through the first mounting plate; and
the first mounting plate being positioned in between the handlebar of the first mounting fastener and the bottom surface.

8. The umbrella stand as claimed in claim 6 comprises:
the male-threaded rod of the second mounting fastener traversing through the second mounting plate; and
the second mounting plate being positioned in between the handlebar of the second mounting fastener and the bottom surface.

9. The umbrella stand as claimed in claim 1 comprises:
the mounting assembly further comprises a plurality of mounting holes;
the plurality of mounting holes traversing through the support plate; and
the plurality of mounting holes being perimetrically distributed across the support plate.

10. An umbrella stand comprises:
a mounting assembly;
a rod holder;
the mounting assembly comprises a support plate, a first mounting plate, a second mounting plate, a first mounting fastener, and a second mounting fastener;
the rod holder comprises a holder tube and a plurality of holder fasteners;
the support plate comprises a top surface and a bottom surface;
the holder tube being connected adjacent and normal to the top surface;
each of the plurality of holder fasteners being laterally engaged into the holder tube;
the first mounting plate being positioned parallel to the bottom surface;
the first mounting plate being mounted offset from the bottom surface by the first mounting fastener;
the first mounting fastener being positioned adjacent to the holder tube;
the second mounting plate being positioned parallel to the bottom surface;
the second mounting plate being mounted offset from the bottom surface by the second mounting fastener;
the second mounting fastener being positioned adjacent to the holder tube;
the rod holder further comprises a sizing tube;
the sizing tube being concentrically nested within the holder tube; and
the plurality of holder fasteners traversing into the holder tube and the sizing tube.

11. The umbrella stand as claimed in claim 10 comprises:
the support plate further comprises a first mounting slot and a second mounting slot;
the first mounting slot traversing through the support plate from the top surface to the bottom surface;
the second mounting slot traversing through the support plate from the top surface to the bottom surface;
the first mounting slot being positioned adjacent to the holder tube;
the first mounting fastener being slidably engaged through the first mounting slot; and
the second mounting fastener being slidably engaged through the second mounting slot.

12. The umbrella stand as claimed in claim 10 comprises:
the first mounting fastener and the second mounting fastener each comprise a hand knob and a screw handle;
the screw handle comprises a handlebar and a male-threaded rod;
the handlebar being connected perpendicular and adjacent to the male-threaded rod;
the male-threaded rod traversing through the support plate, normal to the bottom surface;
a female-threaded portion of the hand knob being engaged about the male-threaded rod;
the male-threaded rod of the first mounting fastener traversing through the first mounting plate;
the first mounting plate being positioned in between the handlebar of the first mounting fastener and the bottom surface;
the male-threaded rod of the second mounting fastener traversing through the second mounting plate; and
the second mounting plate being positioned in between the handlebar of the second mounting fastener and the bottom surface.

13. The umbrella stand as claimed in claim 10 comprises:
the mounting assembly further comprises a plurality of mounting holes;
the plurality of mounting holes traversing through the support plate; and
the plurality of mounting holes being perimetrically distributed across the support plate.

14. An umbrella stand comprises:
a mounting assembly;
a rod holder;
the mounting assembly comprises a support plate, a first mounting plate, a second mounting plate, a first mounting fastener, a second mounting fastener, and a plurality of mounting holes;
the rod holder comprises a holder tube and a plurality of holder fasteners;
the support plate comprises a top surface, and a bottom surface;
the holder tube being connected adjacent and normal to the top surface;
each of the plurality of holder fasteners being laterally engaged into the holder tube;
the first mounting plate being positioned parallel to the bottom surface;
the first mounting plate being mounted offset from the bottom surface by the first mounting fastener;
the first mounting fastener being positioned adjacent to the holder tube;
the plurality of mounting holes traversing through the support plate;

the plurality of mounting holes being perimetrically distributed across the support plate;

the rod holder further comprises a sizing tube;

the sizing tube being concentrically nested within the holder tube; and the plurality of holder fasteners traversing into the holder tube and the sizing tube.

15. The umbrella stand as claimed in claim 14 comprises:

the second mounting plate being positioned parallel to the bottom surface;

the second mounting plate being mounted offset from the bottom surface by the second mounting fastener; and the second mounting fastener being positioned adjacent to the holder tube.

16. The umbrella stand as claimed in claim 14 comprises:

the support plate further comprises a first mounting slot and a second mounting slot;

the first mounting slot traversing through the support plate from the top surface to the bottom surface;

the second mounting slot traversing through the support plate from the top surface to the bottom surface;

the first mounting slot being positioned adjacent to the holder tube;

the first mounting fastener being slidably engaged through the first mounting slot; and the second mounting fastener being slidably engaged through the second mounting slot.

17. The umbrella stand as claimed in claim 14 comprises:

the first mounting fastener and the second mounting fastener each comprise a hand knob and a screw handle;

the screw handle comprises a handlebar and a male-threaded rod;

the handlebar being connected perpendicular and adjacent to the male-threaded rod;

the male-threaded rod traversing through the support plate, normal to the bottom surface;

a female-threaded portion of the hand knob being engaged about the male-threaded rod;

the male-threaded rod of the first mounting fastener traversing through the first mounting plate;

the first mounting plate being positioned in between the handlebar of the first mounting fastener and the bottom surface;

the male-threaded rod of the second mounting fastener traversing through the second mounting plate; and the second mounting plate being positioned in between the handlebar of the second mounting fastener and the bottom surface.

* * * * *